US009409689B2

(12) United States Patent
Nguyen

(10) Patent No.: US 9,409,689 B2
(45) Date of Patent: Aug. 9, 2016

(54) EASY OPENING DISPLAY PACKAGE FOR MERCHANDISE

(75) Inventor: Quang Nguyen, Hillsborough, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 13/129,308

(22) PCT Filed: Dec. 13, 2010

(86) PCT No.: PCT/US2010/060095
§ 371 (c)(1),
(2), (4) Date: May 13, 2011

(87) PCT Pub. No.: WO2012/082099

PCT Pub. Date: Jun. 21, 2012

(65) Prior Publication Data

US 2012/0145567 A1 Jun. 14, 2012

(51) Int. Cl.
*B65D 83/10* (2006.01)
*B65D 75/32* (2006.01)
(Continued)

(52) U.S. Cl.
CPC ..... *B65D 75/326* (2013.01); *B65D 75/366* (2013.01); *B65D 75/5844* (2013.01); *B65D 2575/3236* (2013.01); *B65D 2575/367* (2013.01)

(58) Field of Classification Search
CPC ..... B44D 3/125; A45D 44/18; B65D 75/326; B65D 75/5844; B65D 75/366; B65D 75/367; B65D 2575/3236; B65D 75/30
USPC ..... 206/361, 362.2, 362.3, 368, 63.5, 467, 206/469, 471, 461, 462, 209, 209.1, 362, 206/362.1, 15.2, 15.3, 362.4; 220/270, 266, 220/265; 229/200, 205, 206, 207
See application file for complete search history.

(56) References Cited

U.S. PATENT DOCUMENTS 3,121,493 A * 2/1964 Snape ..... 206/469
3,255,880 A 6/1966 Grossman
(Continued)

FOREIGN PATENT DOCUMENTS

CA 2297359 7/2001
CH 401356 10/1965
(Continued)

OTHER PUBLICATIONS

International Search Report and Written Opinion in International Application No. PCT/US10/060095, mailed Sep. 5, 2011.

*Primary Examiner* — Jacob K Ackun
*Assistant Examiner* — Jenine Pagan

(57) ABSTRACT

A display package for an item of merchandise, e.g., a toothbrush. The package is formed of a first wall member, e.g., a blister body, having a recess and a peripheral flange. A second elongated wall member, e.g., a planar sheet of film having an inner surface and an outer surface, is fixedly secured by its inner surface to the peripheral flange of the first wall member to enclose the item of merchandise therebetween. The second wall member includes an access window formed by a pair of elongated frangible lines and an access slit. Each of the frangible lines is cut only partially through the thickness of the second wall member, starting from the inner surface of the second wall member. The access slit is located at one end of each of the frangible lines. The window is arranged to be opened by a user grasping portions of the second wall member at the access slit to break the frangible lines and thereby provide access to the item of merchandise.

10 Claims, 2 Drawing Sheets

(51) Int. Cl.

| | |
|---|---|
| ***B65D 75/36*** | (2006.01) |
| ***B65D 75/58*** | (2006.01) |

(56) References Cited

U.S. PATENT DOCUMENTS

| | | | | |
|---|---|---|---|---|
| 3,498,446 | A * | 3/1970 | Lafreniere | 229/162.6 |
| 3,970,194 | A * | 7/1976 | Iten | 206/228 |
| 3,982,685 | A * | 9/1976 | Shimada | 229/207 |
| 4,209,095 | A * | 6/1980 | Dutcher | 206/469 |
| 4,266,666 | A * | 5/1981 | Kuchenbecker | 206/461 |
| 4,569,442 | A * | 2/1986 | Bushey | 206/469 |
| 4,577,762 | A * | 3/1986 | Kuchenbecker | 229/207 |
| 5,735,404 | A * | 4/1998 | Kumakura et al. | 206/469 |
| 5,899,333 | A * | 5/1999 | Williams et al. | 206/469 |
| 6,029,818 | A * | 2/2000 | Kumakura et al. | 206/469 |
| 6,276,529 | B1 | 8/2001 | Feehan, Jr. | |
| 6,439,390 | B1 * | 8/2002 | Kumakura et al. | 206/705 |
| 6,520,329 | B1 * | 2/2003 | Fuchs et al. | 206/449 |
| 7,513,369 | B1 | 4/2009 | Lee | |
| 2001/0032796 | A1 * | 10/2001 | Rubenstein | 206/461 |
| 2008/0035520 | A1 * | 2/2008 | Caracciolo et al. | 206/531 |
| 2008/0308449 | A1 * | 12/2008 | Intini | 206/532 |
| 2009/0184017 | A1 | 7/2009 | Doherty | |
| 2010/0230312 | A1 | 9/2010 | Sorrentino et al. | |
| 2012/0048760 | A1 * | 3/2012 | Karey et al. | 206/361 |

FOREIGN PATENT DOCUMENTS

| | | | |
|---|---|---|---|
| CN | 2589376 | | 12/2003 |
| EP | 0844193 | | 5/1998 |
| EP | 1201560 | | 5/2002 |
| GB | 951214 | | 3/1964 |
| GB | 1580791 | | 12/1980 |
| JP | 55-033265 | U | 3/1980 |
| JP | 56-065858 | U | 6/1981 |
| JP | 2003040330 | A | 2/2003 |
| KR | 10-0902264 | | 6/2009 |
| WO | WO 2008/039248 | | 4/2008 |
| WO | WO 2010/075242 | | 7/2010 |

* cited by examiner

EASY OPENING DISPLAY PACKAGE FOR MERCHANDISE

BACKGROUND

The invention relates generally to packages and more specifically to blister or clam-shell type packages with easy open features to facilitate access to the contents of the package.

Various blister and clam-shell type packages exist in the prior art for holding articles of merchandise for display purposes. Some of those packages include perforated lines in at least one of the walls making up the package. The perforated lines are arranged to be broken by pulling on portions of the package adjacent those lines to provide access to the contents of the package. The patented prior art includes several examples of such packages. See for example, U.S. Pat. No. 6,276,529, U.S. Published Applications US 2009/0184017A1 and US2010/0230312A1, and Japanese Application JP 2003040330.

While the foregoing packages are generally suitable for their intended purposes, they leave something to be desired from the standpoints of simplicity of construction and ease of opening.

Accordingly, a need exists for a package for displaying an item of merchandise, where the package is simple in construction and includes means to facilitate the opening of the package. The subject invention addresses that need.

SUMMARY

Accordingly, one aspect of this invention entails a package for an item of merchandise, e.g., a toothbrush. The package basically comprises a first elongated wall member and a second elongated wall member. The first elongated wall member has a longitudinal axis and a recess extending along that axis. The second elongated wall member is generally coextensive in size with the first wall member and has an inner surface and an outer surface. The inner surface of the second wall member is fixedly secured to the first wall member to enclose the item of merchandise within that recess. The second wall member comprises a pair of elongated frangible lines and an access slit. The frangible lines extend generally parallel to each other along the longitudinal axis for a major length of the recess. Each of the frangible lines is cut only partially through the thickness of the second wall member, starting from the inner surface of the second wall member. The access slit is located at one end of each of the frangible lines. Portions of the elongated second wall member contiguous with the slit are arranged to be grasped by a user to break the frangible lines and thereby provide access to the item of merchandise.

In certain embodiments, each of the frangible lines comprises a die-cut line.

In certain embodiments, the first wall member comprises a preformed blister wall, with the blister wall being transparent to enable the item of merchandize to be seen therethrough.

In certain embodiments, the second elongated wall member comprises a planar sheet of polymeric film.

In certain embodiments, the package additionally comprises a hook portion to enable the package to be suspended thereby.

A second aspect of the invention comprises the combination of a package, like that described above, and an item of merchandise, e.g., a toothbrush, held within the package.

BRIEF DESCRIPTION OF THE DRAWINGS

The invention will be illustrated with reference to the attached drawings, which are briefly described immediately below.

DETAILED DESCRIPTION

As used throughout, ranges are used as a shorthand manner for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

The invention is further described in the following examples. The examples are merely illustrative and do not in any way limit the scope of the invention as described and claimed.

Figure 1:
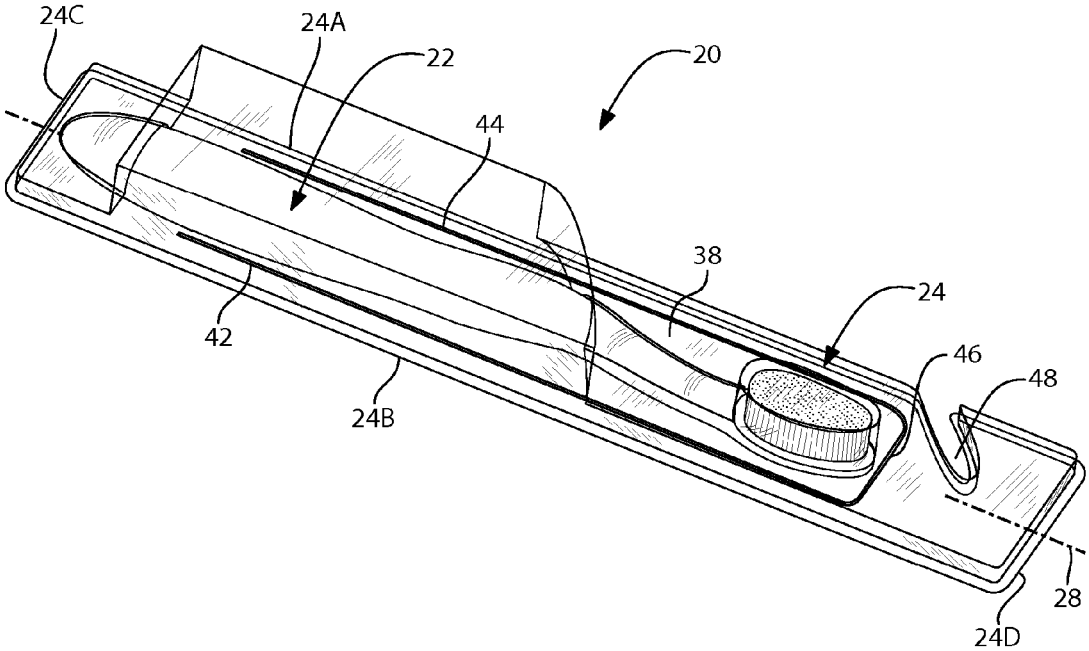
FIG. 1 is a top plan view of one exemplary embodiment of a display package constructed in accordance with this invention, with the package including a top wall member and a bottom wall member fixedly secured to each other to define an interior chamber in which an item of merchandise is held.

Referring now to the drawing wherein like reference numbers refer to like parts there is shown at 20 in FIG. 1 one exemplary embodiment of a display package constructed in accordance with this invention. The package 20 is arranged to hold an item of merchandise. In the exemplary embodiment shown, the item of merchandise is a toothbrush 22, but could be any product. The particular embodiment of the display package 20 shown in FIG. 1 is a blister-type package. Alternatively, it can be in the form of a clam-shell type package. In either case the package basically comprises a pair of wall members which are fixedly secured to each other to form an item-receiving chamber (to be described later) therebetween. In the exemplary embodiment blister package 20 comprises a first wall member 24 (FIGS. 1 and 2) and a second wall member 26 (FIGS. 2-5).

The first wall member is a hollow body 24 formed of any suitable material, including a laminate of suitable materials e.g., a paper pulp based material, a polymeric material, such as, but not limited to polyvinyl chloride (PVC), polyethylene terephthalate (PET), etc., or any other polymeric material known for use in blister pack or clam-shell packaging. The material making up the body 24 may comprise a combination of materials, including transparent, partially transparent, semi-transparent, and/or opaque materials and may be formed in any manner, such as injection or blow molding. In the exemplary embodiment shown, the first wall member 24 is a transparent elongated member having a longitudinal axis 28, a pair of long side edges 24A and 24B extending parallel to the axis 28 and a pair of short end edges 24C and 24D extending transversely to the axis 28. A recess 30 (FIG. 2) for receipt of the item of merchandise extends substantially the full length of the wall member 24, except for the top portion (the portion adjacent edge 24D) which forms a header of the package. The recess 30 can be of uniform width and depth along its entire length or can be profiled to the specific profile of the item of merchandise as shown in FIG. 1. In the exemplary embodiment shown the recess is profiled to conform to the profile of the toothbrush 22.

Figure 2:
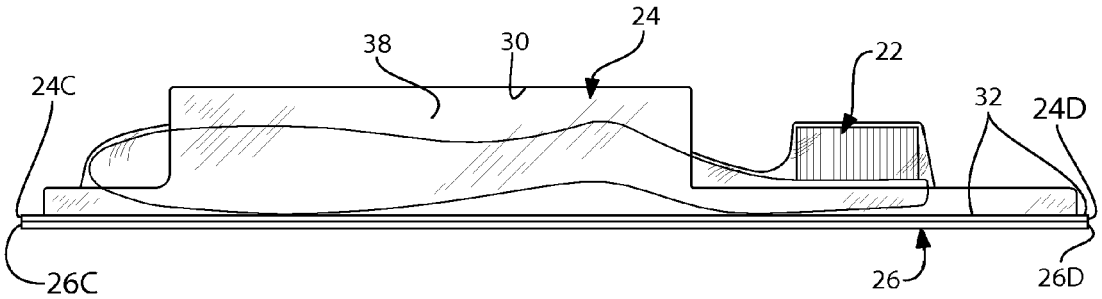
FIG. 2 is a side elevation view of the package shown in FIG. 1.

As best seen in FIG. 2, a generally planar flange 32 extends outward about the entire periphery of the recess 30 of the body 24 to form its edges 24A-24D. The flange 32 serves as the means for securing the second wall member 26 to the first wall member 24.

Figure 3:
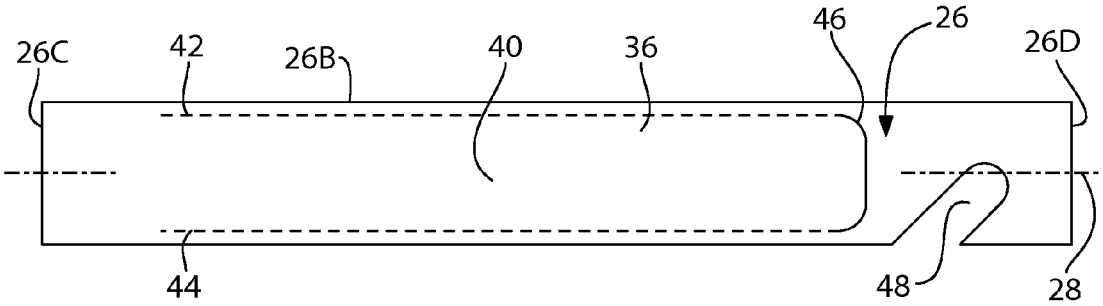
FIG. 3 is a bottom plan view of the package shown in FIGS. 1 and 2.
Figure 4:
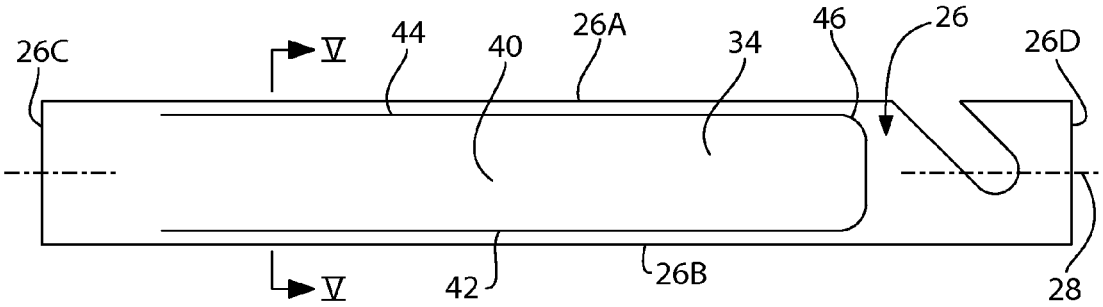
FIG. 4 is a plan view of the inner surface of the bottom wall member shown in FIG. 3.
Figure 5:
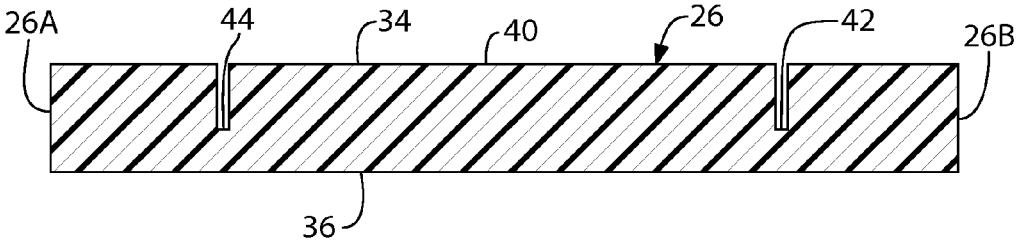
FIG. 5 is an enlarged sectional view taken along line 5-5 of FIG. 4.

The second wall member 26, which serves as the backer of the package, basically comprises a planar member of corresponding size and shape to the first wall member 24. Thus, as best seen in FIGS. 3 and 4, the backer wall member 26 includes a pair of long side edges 26A and 26B extending parallel to the axis 28 and a pair of short side edges 26C and 26D extending transverse to the axis 28. The backer wall member 26 can be formed of a paper pulp based material, a polyvinyl chloride (PVC), polyethylene terephthalate (PET), etc., or any other suitable flexible polymeric sheet or film material or laminate formed with such materials and includes an inner surface 34 (FIGS. 4 and 5) and an outer surface 36 (FIGS. 3 and 5). As best seen in FIG. 2, the inner surface 34 of the backer wall member adjacent its peripheral edges 26A-26D is fixedly secured, e.g., thermally welded to the flange 32 of the first wall member 24. Other means, e.g., an adhesive, for fixedly securing the flange of the wall member 24 to the backer wall member 26 may be used in lieu of thermal bonding. In any case, the securement of the two wall members 24 and 26 together creates an enclosed cavity or chamber 38 (made up of the recess 30 and the contiguous inner surface of the wall member 26) in which the item of merchandise, e.g., the toothbrush 22, is retained.

Access to the chamber 38 is accomplished through a window 40 (FIG. 3) in the backer wall member 26. The window 40 is formed by a pair of frangible or otherwise weakened lines 42 and 44 and an access slit 46. In particular as can be seen best in FIGS. 3 and 4 a pair of frangible lines 42 and 44 extend substantially the entire length, e.g., 4 inches, of the recess 30 on opposite sides of the longitudinal axis 28. The frangible lines 42 and 44 may be linear, or non-linear in shape. Each of the frangible lines 42 and 44 comprises a partial cut on the inner surface 34 of the backer wall member 26, i.e., the cut extends from the inner surface 34 of the wall member 26 partially through its thickness, but not to the outer surface 36. The partial cut can be formed by any suitable means or method, e.g., it may be die-cut. While the frangible lines are die-cut on the inner surface 34 of the hacker wall member 26, alternatively if desired, they may be die-cut on its outer surface 36. Moreover, the frangible lines 42 and 44 may be formed in other ways than by die-cutting, e.g., any processes that may produce a weakened line that can be readily broken by pulling.

In any case, the frangible lines 42 and 44 are constructed so that they are substantially weakened along their length so that they can be readily broken or torn by pulling on portions of the wall contiguous with them. The access slit 46 serves as the means for achieving that end, i.e., it enables the user of the package 20 to grasp portions of the backer wall member 26 contiguous with the frangible lines 42 and 44 to open the window 40.

The access slit is best seen in FIGS. 3 and 4 and is of elongated linear shape, having a pair of radiussed (curved) ends. The invention is not so limited, however, and the access slit 46 may be a non-linear shape, such as curved. The access slit 46 extends (is cut) through the full thickness of the backer wall member 26 and is located with its curved ends either intersecting or being immediately adjacent respective ends of the frangible lines 42 and 44. Accordingly, portions of the backer wall member 26 contiguous with the slit 46 can be grasped between the user's thumb and finger to enable the user to pull upward (away) from the plane of the backer wall member. That action applies a stress to the ends of the frangible lines 42 and 44 contiguous with the slit 46, whereupon those lines begin to break. The break propagates along the length of the lines 42 and 44 so long as the user applies the pulling force to the backer wall member, thereby opening the window 40 to provide access to the chamber 38 where the toothbrush 22 is held.

The upper end of the package 20 serves as a header for the package and includes a recess 48 forming a hook to suspend the package for display. While not shown the package may include indicia thereon.

As should be appreciated by those skilled in the art, the use of frangible lines which only extend partially through the thickness of the wall member 26 provides advantages over devices making use of perforated lines which extend through the full thickness of the material in which the lines are located. For example, the partial depth cut provides an aesthetically pleasing appearance (e.g., the frangible lines 42 and 44 are not visible from the underside of the package). Moreover, the fact that the frangible lines do not extend fully through the thickness of the backing wall member reduces the chances of contaminants or moisture from gaining ingress therethrough into the chamber 40 holding the item of merchandise. This later factor may be very significant, depending upon the type of merchandise held in the package. Additionally, the partial depth cut results in a smooth edge after opening the package, versus the sharp edges that result after opening packages having the perforated lines which extend through the full thickness of the material.

What is claimed is:

1. A display package comprising:

a first elongated wall member having a longitudinal axis and a recess extending along said longitudinal axis;

a toothbrush disposed in said recess, said toothbrush comprising a head;

a second elongated wall member comprising:

an inner surface, an outer surface comprising an underside of the display package, a pair of elongated frangible lines, and an access slit, wherein:

said inner surface of said second elongated wall member is fixedly secured to said first wall member to enclose said toothbrush within said recess, said frangible lines extend generally parallel to each other along said longitudinal axis for a major length of said recess, each of said elongated frangible lines is cut only partially through the thickness of said second wall member, said elongated frangible lines are not visible from the underside of the display package, said access slit is located at one end of each of said elongated frangible lines, and portions of said second elongated wall member are contiguous with said access slit, said portions being:

located entirely within a perimeter of said second elongated wall member, located near the head of the toothbrush, and arranged to be grasped by a user to break said elongated frangible lines and thereby provide access to the toothbrush.

2. The display package of claim 1, wherein each of said frangible lines is cut from said inner surface of said second elongated wall member.

3. The display package of claim 1, wherein each of said elongated frangible lines comprises a die-cut line.

4. The display package of claim 1, wherein said first elongated wall member comprises a preformed blister wall.

5. The display package of claim 4, wherein the preformed blister wall is transparent to enable the toothbrush to be seen therethrough.

6. The display package of claim 1, wherein said second elongated wall member comprises a planar sheet of polymeric film.

7. The display package of claim 1 additionally comprising:

a hook portion enabling the display package to be suspended thereby, the hook portion including a curved portion and a linear portion, wherein:

the linear portion is at an angle with respect to said longitudinal axis of said first elongated wall member, and one end of said access slit is located closer to the linear portion than to the curved portion of the hook portion.

8. The display package of claim 1, wherein:

the second elongated wall member is a backer of the display package;

the second elongated wall member consists of a single material;

the single material forms an innermost surface of the second elongated wall member; and the single material forms an outermost surface of the second elongated wall member.

9. The display package of claim 8, wherein:

the first elongated wall member comprises a planar flange extending outward about an entire periphery of the recess; and the outermost surface of the second elongated wall member is fixedly secured to the first elongated wall member via the planar flange.

10. The display package of claim 8, wherein the single material consists of a single planar sheet of polymeric film.

* * * * *